US012467330B2

(12) United States Patent
Thomson et al.

(10) Patent No.: US 12,467,330 B2
(45) Date of Patent: Nov. 11, 2025

(54) RISER-LESS MANAGED PRESSURE OPERATIONS

(71) Applicant: Weatherford Technology Holdings, LLC, Houston, TX (US)

(72) Inventors: Gordon Thomson, Houston, TX (US); John D. Hooker, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 18/836,918

(22) PCT Filed: Jan. 6, 2023

(86) PCT No.: PCT/IB2023/050120
§ 371 (c)(1),
(2) Date: Aug. 8, 2024

(87) PCT Pub. No.: WO2023/175400
PCT Pub. Date: Sep. 21, 2023

(65) Prior Publication Data

US 2025/0075580 A1 Mar. 6, 2025

Related U.S. Application Data

(60) Provisional application No. 63/319,386, filed on Mar. 13, 2022.

(51) Int. Cl.
*E21B 33/038* (2006.01)
*E21B 21/08* (2006.01)
*E21B 37/00* (2006.01)

(52) U.S. Cl.
CPC ..... *E21B 33/038* (2013.01); *E21B 21/08* (2013.01); *E21B 37/00* (2013.01)

(58) Field of Classification Search
CPC ..... E21B 33/038; E21B 21/08; E21B 37/00
See application file for complete search history.

(56) References Cited

U.S. PATENT DOCUMENTS 3,688,840 A * 9/1972 Curington ..... E21B 33/038 166/344
8,776,894 B2 * 7/2014 Orbell ..... E21B 7/12 166/359

(Continued)

FOREIGN PATENT DOCUMENTS

WO 00/34619 A1 6/2000
WO 2014/182709 A1 11/2014
WO 2021/094717 A1 5/2021

OTHER PUBLICATIONS

International Search Report with Written Opinion issued Mar. 3, 2023 for PCT Patent Application No. PCT/IB2023/050120, 9 pages.

*Primary Examiner* — Aaron L Lembo
(74) *Attorney, Agent, or Firm* — Smith IP Services, P.C.

(57) ABSTRACT

A subsea assembly can include a pressure control device having an annular seal configured to seal off an annulus formed between an outer housing and a tubular string, a connector, and a guide configured to guide the tubular string into an internal flow passage extending through the subsea assembly, the pressure control device being connected between the connector and the guide. A method can include assembling a subsea assembly with a pressure control device and a connector, the pressure control device including an outer housing and an annular seal, lowering the subsea assembly through water from a rig to a subsea wellhead installation, connecting the subsea assembly to the subsea wellhead installation, and positioning a tubular string in the subsea assembly, so that the annular seal seals against an (Continued)

external surface of the tubular string, the tubular string being exposed to the water between the rig and the subsea assembly.

18 Claims, 4 Drawing Sheets

(56) References Cited

U.S. PATENT DOCUMENTS

| | | | | |
|---|---|---|---|---|
| 11,193,340 | B2 * | 12/2021 | Bansal | E21B 19/16 |
| 2014/0190701 | A1 * | 7/2014 | Humphreys | E21B 33/038 166/345 |
| 2022/0381105 | A1 * | 12/2022 | Wilson | E21B 21/08 |

* cited by examiner

RISER-LESS MANAGED PRESSURE OPERATIONS

CROSS-REFERENCE TO RELATED APPLICATIONS

This application is a national phase under 35 USC 371 of International Application No. PCT/IB2023/050120 filed on 6 Jan. 2023, which claims the benefit of the filing date of U.S. provisional application No. 63/319,386 filed on 13 Mar. 2022. The entire disclosures of these prior applications are incorporated herein by this reference.

TECHNICAL FIELD

This disclosure relates generally to equipment utilized and operations performed in conjunction with a subterranean well and, in one example described below, more particularly provides for riser-less managed pressure operations.

BACKGROUND

In managed pressure operations, pressure in a wellbore can be precisely controlled by controlling flow rates of fluids into and out of the wellbore, controlling pressures applied from surface to the wellbore, controlling a density of the fluids in the wellbore, and by isolating the wellbore from the atmosphere (or from the water in subsea operations) so that the wellbore is substantially a closed volume. In subsea managed pressure operations, a tubular conduit known as a riser is typically used to conduct the fluids flowing between the wellbore and a rig (which may be floating or supported from the sea floor).

To isolate the wellbore from the atmosphere in subsea managed pressure operations, a device known as a pressure control device (also known as a rotating blowout preventer, rotating control head or rotating control device) is typically connected in the riser. The pressure control device seals off an annulus formed between the riser and an exterior surface of a tubular string in the riser. In a conventional rotating control device, a seal is rotatably mounted in an outer housing, so that the seal can rotate with the tubular string relative to the outer housing (for example, in drilling operations in which the tubular string is rotated). The seal may not rotate in other types of pressure control devices.

It will, therefore, be readily appreciated that improvements are continually needed in the arts of constructing equipment for use in managed pressure operations, and conducting such managed pressure operations. It is among the objects of the present disclosure to provide such improvements to the arts.

DETAILED DESCRIPTION

Figure 1:
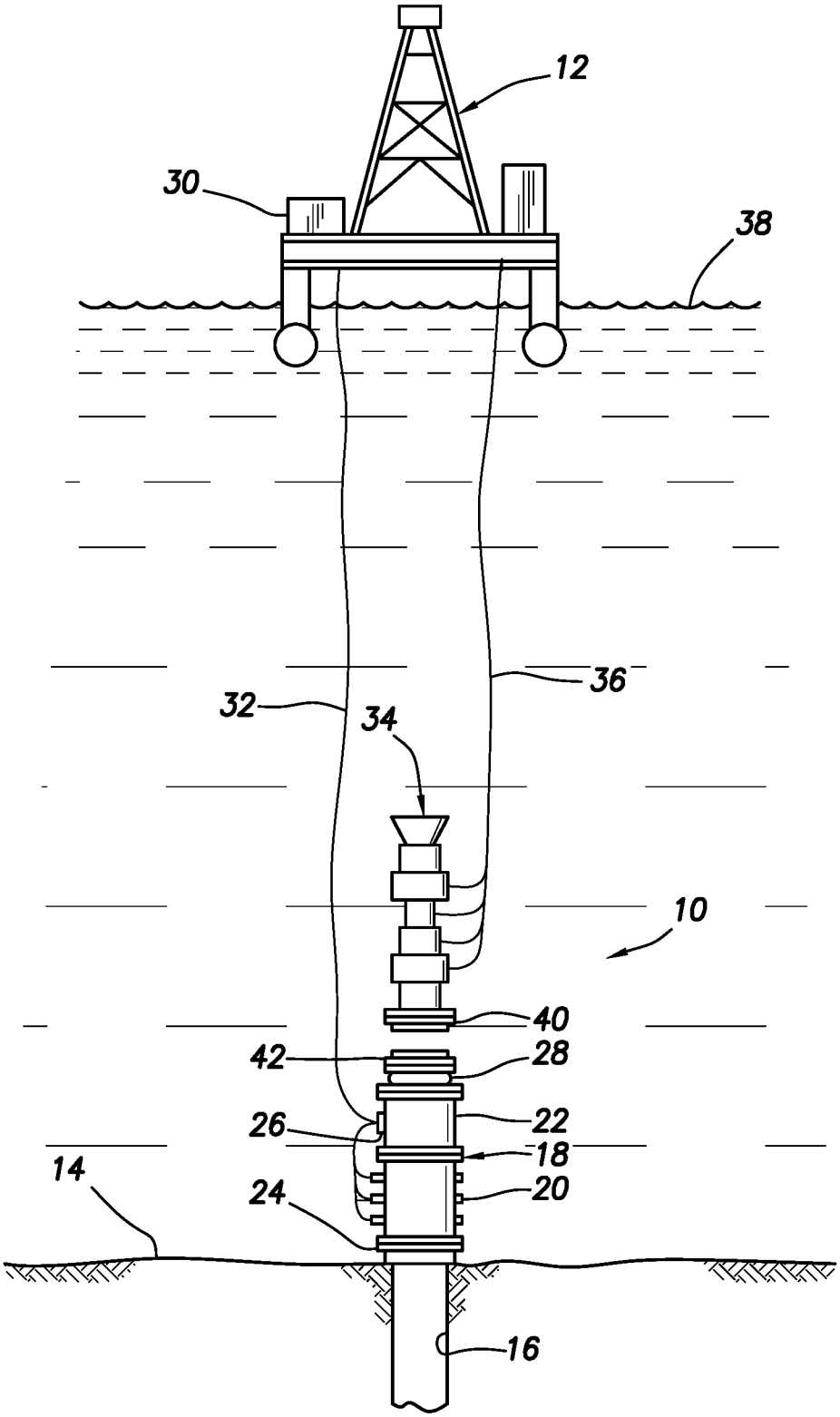
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a water-based rig 12 is used to conduct well operations. The rig 12 may be a floating rig (such as a drill ship or a semi-submersible rig) or may be supported on a sea floor 14 (such as a jack-up rig). The scope of this disclosure is not limited to use of any particular type of rig.

The system 10 is designed to provide for managed pressure operations in a wellbore 16, without use of a riser extending between the rig 12 and a subsea wellhead installation 18. In this manner, the cost, time and effort needed to install a riser is eliminated.

As depicted in FIG. 1, the wellhead installation 18 includes a blowout preventer stack 20 and a lower marine package 22 connected above a wellhead 24. The lower marine package 22 can include a control pod 26 and a flex joint 28 The control pod 26 may be in electric, hydraulic, and/or optical communication via an umbilical 32 with a rig controller 30 onboard the rig 12.

The control pod 26 may include one or more control valves (not shown) in communication with respective individual blowout preventers of the blowout preventer stack 20 for operation thereof. Each control valve may include an electric or hydraulic actuator in communication with the umbilical 32. The umbilical 32 may include one or more hydraulic or electric control conduits or cables for the actuators. Accumulators may be provided to store pressurized hydraulic fluid for operating the blowout preventer stack 20.

Additionally, the accumulators may be used for operating one or more components of a subsea assembly 34 to be connected to the wellhead installation 18. The umbilical 32 may further include hydraulic, electric, and/or optic control conduit or cables for controlling various functions of the subsea assembly 34. The rig controller 30 may operate the subsea assembly 34 via the umbilical 32 and the control pod 26. Alternatively, a separate umbilical 36 can be provided to control the components and functions of the subsea assembly 34.

The subsea assembly 34 is lowered through water 38 from the rig 12 to the wellhead installation 18. Guide cables, remotely operated vehicles and/or other equipment and techniques (not shown) may be used to guide the subsea assembly 34 from the rig 12 to the wellhead installation 18 through the water 38.

A subsea connector 40 of the subsea assembly 34 is then used to releasably connect the subsea assembly 34 to a mating subsea connector 42 of the wellhead installation 18. The flex joint 28 permits a limited amount of deflection of the subsea connector 42 relative to the lower marine package 22. In other examples, the flex joint 28 could be connected above the subsea connector 40 of the subsea assembly 34, in which case the flex joint can permit a limited amount of deflection of the subsea assembly 34 above the flex joint relative to the lower marine package 22.

The subsea assembly 34 does not include any riser connection. Preferably, at no point does a riser extend between the rig 12 and the subsea assembly 34. Instead, managed pressure operations can be carried out in the wellbore 16, without use of a riser to contain a tubular string or to provide a conduit for fluid flow between the wellbore 16 and the rig 12, as described more fully below.

Figure 2:
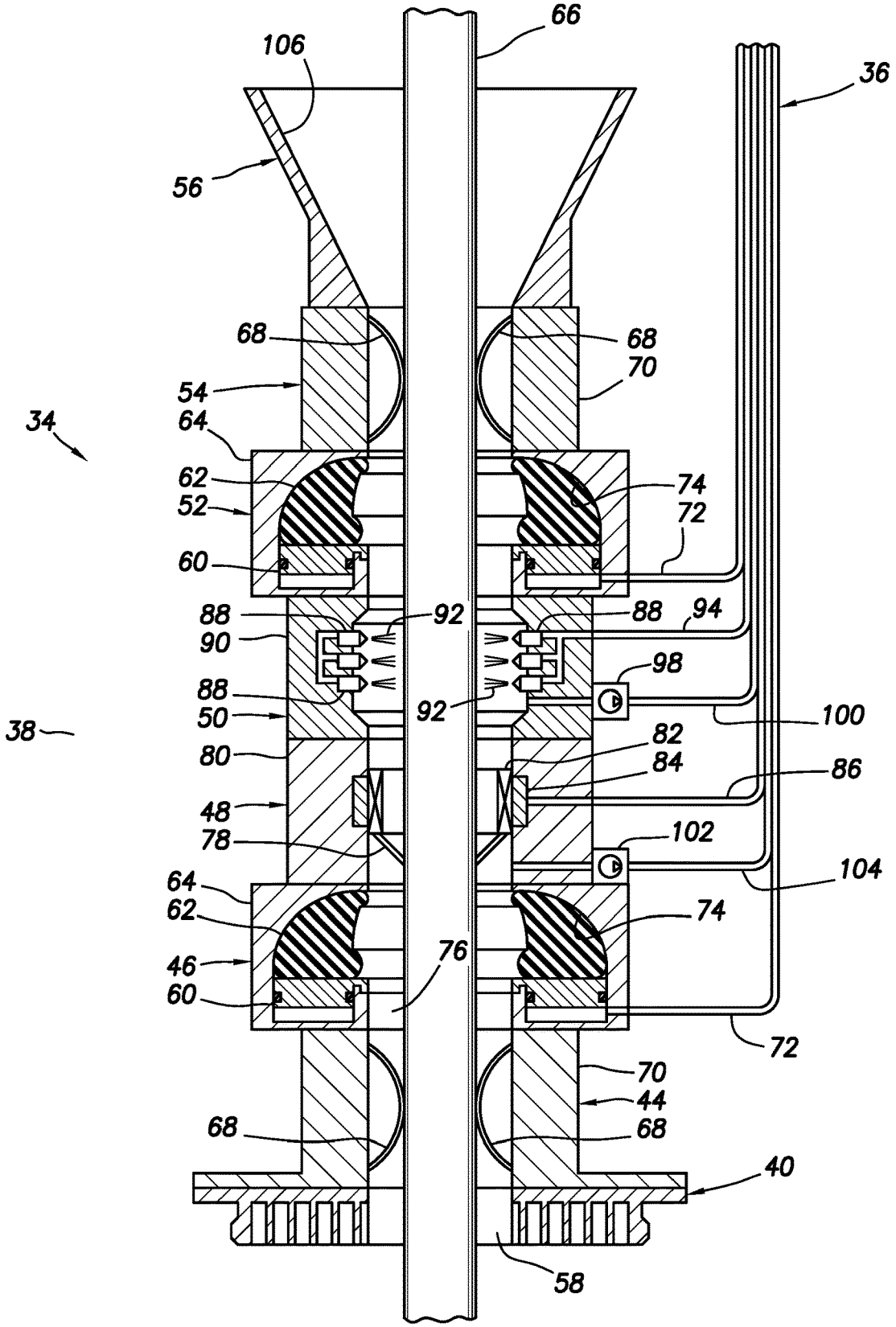
FIG. 2 is a representative partially cross-sectional view of an example of a subsea assembly that may be used in the FIG. 1 well system and method.

Referring additionally now to FIG. 2, a partially cross-sectional view of an example of the subsea assembly 34 is representatively illustrated. The subsea assembly 34 is described below as it may be used with the system 10 and method of FIG. 1, but it should be understood that the subsea assembly may be used with other systems and methods.

In the FIG. 2 example, the subsea assembly 34 includes the subsea connector 40, a lower centralizer 44, a lower annular seal barrier 46, a pressure control device 48, a cleaning assembly 50, an upper annular seal barrier 52, an upper centralizer 54 and a re-entry guide 56. In other examples, the subsea assembly 34 may include more, fewer or different components, or different combinations of components.

The subsea connector 40 is used to releasably attach the subsea assembly 34 to the wellhead installation 18. In some examples, the subsea connector 40 can be hydraulically or electrically operated to latch and unlatch the subsea connectors 40, 42 to each other. In those examples, the umbilical 36 can include a hydraulic or electrical line to operate a latch mechanism (not shown) of the subsea connector 40. The subsea connector 40 can also include a seal (not shown) to isolate an internal flow passage 58 of the subsea assembly 34 from the water 38.

The lower and upper centralizers 44, 54 centralize a tubular string 66 in the flow passage 58. The upper and lower centralizers 44, 54 can include bow springs 68 or other biasing devices in an outer housing 70 to bias the tubular string 66 toward a central axis of the flow passage 58.

The tubular string 66 may comprise any tubulars known to those skilled in the art as injection or production tubing, pipe, drill pipe or tubular well tools. The scope of this disclosure is not limited to use of any particular type of tubulars in the tubular string 66.

The lower and upper annular seal barriers 46, 52 are the same as, or similar to, devices known to those skilled in the art as annular blowout preventers or annular isolation devices. The annular seal barriers 46, 52 in this example are hydraulically operated. Each annular seal barrier 46, 52 includes an annular piston 60 and a radially inwardly extendable annular seal 62 in an outer housing 64.

When sufficient fluid pressure is applied to the piston 60 via a hydraulic line 72 of the umbilical 36, the piston displaces toward the annular seal 62, thereby causing the annular seal to displace radially inward along an inwardly sloping concave spherical surface 74 formed in the outer housing 70. Eventually, the annular seal 62 will sealingly contact an external surface of the tubular string 66, thereby sealing off an annulus 76 formed in the flow passage 58 radially between the tubular string and the subsea assembly 34. Other types of annular seal barriers may be used in other examples.

The annular seal barriers 46, 52 permit most of the flow passage 58 to be isolated from the water 38 as the subsea assembly 34 is conveyed from the rig 12 to the wellhead installation 18. In addition, the annular seal barriers 46, 52 can function as conventional annular blowout preventers to prevent inadvertent escape of well fluids from the wellbore 16 in the event of an influx of fluids into the wellbore (for example, during drilling operations).

The pressure control device 48 includes an annular seal 78 positioned in an outer housing 80. Multiple annular seals 78 may be included in the pressure control device 48 in other examples.

The annular seal 78 sealingly contacts the external surface of the tubular string 66 whenever the tubular string is present in the flow passage 58, and thereby seals off the annulus 76 in the pressure control device 48. In managed pressure operations conducted using the subsea assembly 34, this sealing engagement between the annular seal 78 and the tubular string 66 causes the flow passage 58 and the wellbore 16 below the annular seal to be a substantially closed volume, thereby enabling precise control of fluid pressure in the wellbore.

The annular seal 78 can be designed to effectively seal against the external surface of the tubular string 66 while the tubular string rotates (for example, during drilling operations). In some examples, the annular seal 78 can rotate with the tubular string 66. A bearing assembly 82 can be used to mount the annular seal 78, so that it can rotate relative to the outer housing 80.

A latch assembly 84 can be used to releasably secure the annular seal 78, and the bearing assembly 80 if provided, in the outer housing 80. In this manner, the annular seal 78 and/or bearing assembly 80 can be removed and replaced if needed. A hydraulic line 86 of the umbilical 36 may be used to operate the latch assembly 84.

In the FIG. 2 example, a pump 102 is used to pump fluids from the annulus 76 below the annular seal 78 to the rig 12 via a fluid conduit 104 of the umbilical 36. The pump 102 can facilitate circulation of fluids through the tubular string 66 and the annulus 76, and can be operated in a manner that functions to control the pressure in the wellbore 16 (e.g., when the pump is operating, fluid pressure at an inlet of the pump 102 in communication with the annulus will be reduced as compared to fluid pressure at an outlet of the pump in communication with the fluid conduit 104).

The cleaning assembly 50 is used to remove debris and/or contaminants from the tubular string 66, for example, during retrieval of the tubular string from the well. In the FIG. 2 example, the cleaning assembly 50 includes inwardly facing jet nozzles 88 distributed in an outer housing 90 about the flow passage 58.

The nozzles 88 direct a cleaning fluid 92 toward the outer surface of the tubular string 66. The nozzles may be positioned so that the cleaning fluid 92 is sprayed in a helical, offset or other pattern toward the tubular string 66.

The cleaning fluid 92 may comprise any type of fluid or combination of fluids suitable for cleaning the external surface of the tubular string 66, and preferably does not include any substance that would contaminate the water 38. The cleaning fluid 92 may be delivered to the nozzles 88 via a fluid conduit 94 of the umbilical 36. Alternatively, the cleaning fluid 92 could comprise the water 38, in which case the water could be pumped to the nozzles 88 using a pump, such as the pump 96 depicted in FIG. 4.

A pump 98 can be used to pump the cleaning fluid 92 to the rig 12 for disposal or recycling. The pump 98 in this example has an inlet in communication with the annulus 76 in the cleaning assembly 50 and an outlet in communication with a fluid conduit 100 of the umbilical 36. The inlet of the pump 98 is preferably in communication with the annulus 76 above the annular seal 78 of the pressure control device 48.

The guide 56 facilitates entry of the tubular string 66 into the flow passage 58. The guide 56 in this example includes an inner frusta-conical surface 106 that deflects a lower end of the tubular string 66 inward toward the flow passage 58 when the tubular string is lowered from the rig 12. A remotely operated vehicle or other apparatus may be used to assist in directing the lower end of the tubular string 66 into the guide 56.

Note that the tubular string 66 is exposed to, and in contact with, the water 38 between the rig 12 and the subsea assembly 34. There is no riser to contain the tubular string 66.

Although in FIG. 2 the subsea assembly 34 is depicted as if it is detached from the wellhead installation 18, in actual practice the subsea assembly would be secured to the wellhead installation during managed pressure operations, with the subsea connectors 40, 42 connected to each other. In some examples, the subsea assembly 34 can be conveyed to the wellhead installation 18 with the tubular string 66, in which case the tubular string can be positioned in the flow passage 58 prior to the connectors 40, 42 being connected.

Figure 3:
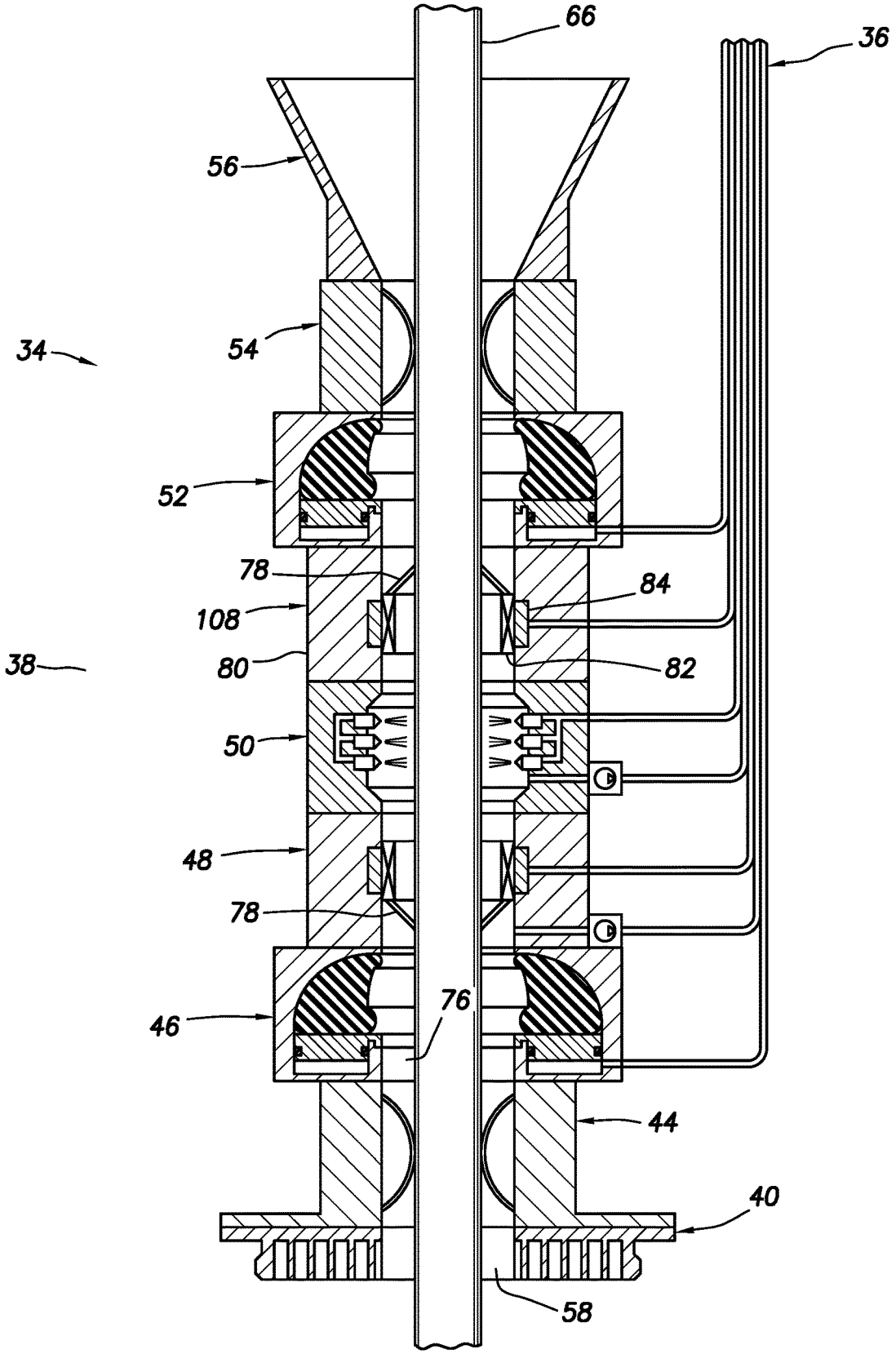
FIG. 3 is a representative partially cross-sectional view of another example of the subsea assembly.

Referring additionally now to FIG. 3, a partially cross-sectional view of another example of the subsea assembly 34 is representatively illustrated. The FIG. 3 example is similar to the FIG. 2 example, but differs at least in that another pressure control device 108 is included in the FIG. 3 subsea assembly 34. As depicted in FIG. 3, the pressure control device 108 is connected between the upper annular seal barrier 52 and the cleaning assembly 50, but this is not necessary. For example, the pressure control device 108 could be connected between the cleaning assembly 50 and the pressure control device 48. The scope of this disclosure is not limited to any particular arrangement or configuration of the components of the subsea assembly 34.

The upper pressure control device 108 is substantially similar to the lower pressure control device 48, in that the upper pressure control device also includes an annular seal 78 positioned in an outer housing 80. In this example, the annular seal 78 is rotatable relative to the outer housing 80 by means of a bearing assembly 82, and is releasably secured in the outer housing with a latch assembly 84.

One difference between the pressure control devices 48, 108 is an orientation of their respective annular seals 78. As depicted in FIG. 3, the annular seal 78 of the lower pressure control device 48 converges longitudinally downward toward the external surface of the tubular string 66 and is, therefore, suited for resisting pressure applied from below the annular seal (such as, pressure in the wellbore 16). In contrast, the annular seal 78 of the upper pressure control device 108 converges longitudinally upward toward the external surface of the tubular string 66 and is, therefore, suited for resisting pressure applied from above the annular seal.

Figure 4:
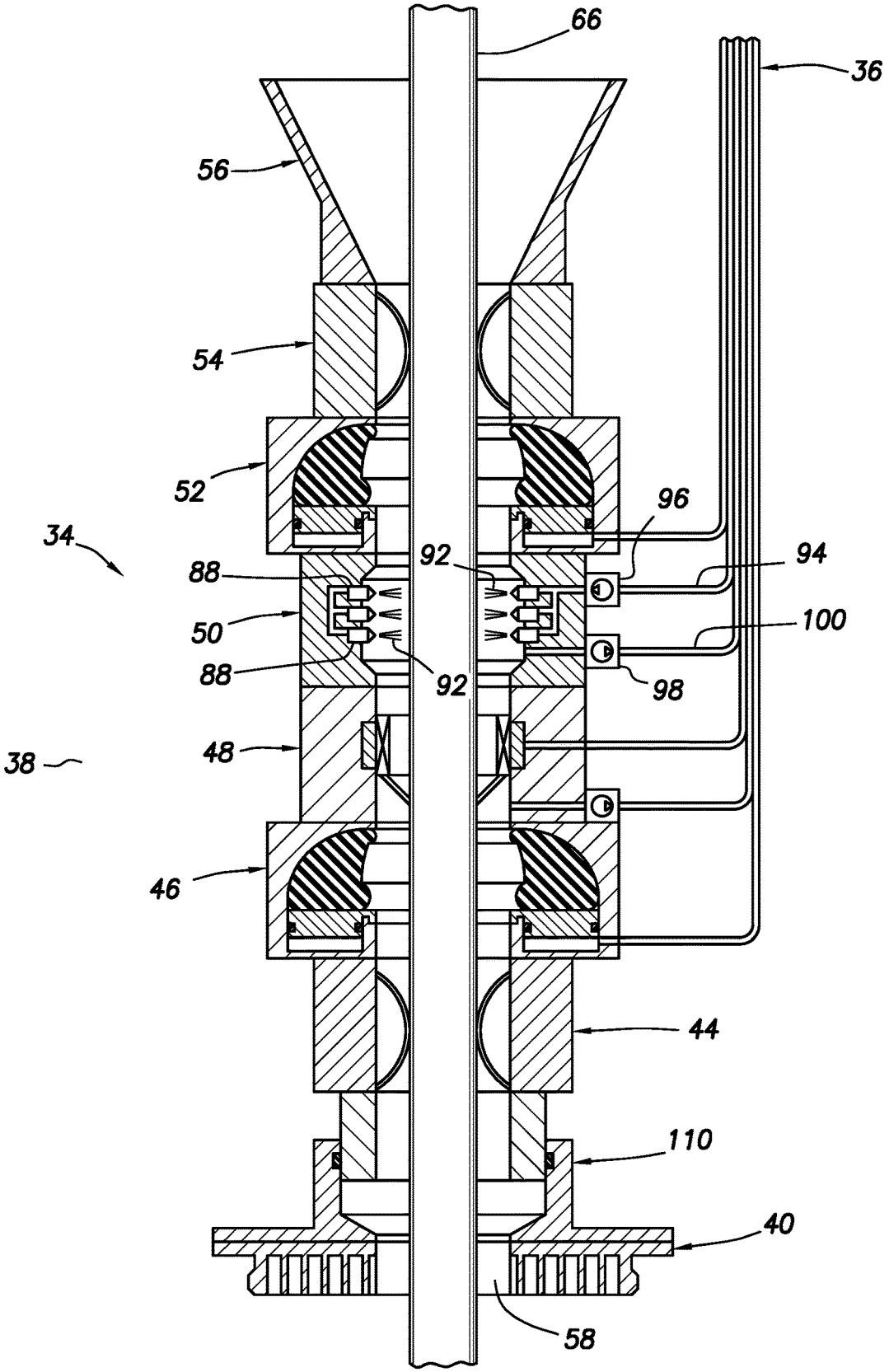
FIG. 4 is a representative partially cross-sectional view of another example of the subsea assembly.

Referring additionally now to FIG. 4, a partially cross-sectional view of another example of the subsea assembly 34 is representatively illustrated. The FIG. 4 example is similar to the FIGS. 2 & 3 examples, but differs at least in that a slip joint 110 is connected in the subsea assembly 34 above the connector 40.

The slip joint 110 is a longitudinally telescoping assembly that is extendable and compressible to allow for longitudinal variations between the connector 40 and the remainder of the subsea assembly 34. Although the slip joint 110 is depicted in FIG. 4 as being connected between the connector 40 and the lower centralizer 44, the slip joint could be connected in other positions in keeping with the scope of this disclosure.

The slip joint 110 may be used with either of the FIGS. 2 & 3 examples of the subsea assembly 34. In addition, the pressure control device 108 of the FIG. 3 example may be used with the FIG. 4 subsea assembly 34.

Another difference of the FIG. 4 example is the addition of another pump 96 to pump the cleaning fluid 92 to the nozzles 88 of the cleaning assembly 50. An inlet of the pump 96 is in communication with the fluid conduit 94. Alternatively, if the water 38 is to be used as the cleaning fluid 92, the inlet of the pump 96 will not be in communication with the fluid conduit 94, but instead will pump the water from the exterior of the subsea assembly 34 (such as, via a filter). The pump 96 may be used with the cleaning assembly 50 of the FIGS. 2 & 3 examples of the subsea assembly 34.

It may now be fully appreciated that the above disclosure provides significant advancements to the arts of constructing equipment for use in managed pressure operations, and conducting such managed pressure operations. In various examples described above, the subsea assembly 34 permits managed pressure operations to be conducted from the water-based rig 12, without using a riser between the rig and the subsea assembly.

The above disclosure provides to the art a subsea assembly 34. In one example, the subsea assembly 34 includes: a first pressure control device 48 comprising an outer housing 80, and an annular seal 78 configured to seal off an annulus 76 formed between the outer housing 80 and a tubular string 66 extending through the outer housing 80; a connector 40 configured to releasably connect the subsea assembly 34 to a subsea wellhead installation 18; and a guide 56 configured to guide the tubular string 66 into an internal flow passage 58 extending through the subsea assembly 34. The first pressure control device 48 is connected between the connector 40 and the guide 56.

The subsea assembly 34 is free of any riser connection. The first pressure control device 34 may include a bearing assembly 82 that permits rotation of the annular seal 78 relative to the outer housing 80.

The subsea assembly 34 can include first and second annular seal barriers 46, 52. The pressure control device 48 may be connected between the first and second annular seal barriers 46, 52. The first annular seal barrier 46 may be configured to seal off the annulus 76 in response to application of fluid pressure to the first annular seal barrier 46, and the second annular seal barrier 52 may be configured to seal off the annulus 76 in response to application of fluid pressure to the second annular seal barrier 52.

The subsea assembly 34 can include a pump 102 having an inlet in communication with the internal flow passage 58 between the first pressure control device annular seal 78 and the connector 40, and an outlet in communication with an umbilical 36 that extends to a rig 12.

The subsea assembly 34 may include a cleaning assembly 50. The cleaning assembly 50 may include nozzles 88 configured to direct a cleaning fluid 92 toward the tubular string 66. The subsea assembly 34 may include a pump 98 having an inlet in communication with the internal flow passage 58 between the nozzles 88 and the first pressure control device annular seal 78, and an outlet in communication with an umbilical 36 that extends to a rig 12.

The subsea assembly 34 may include a second pressure control device 108. The second pressure control device 108 may be connected between the guide 56 and the first pressure control device 48. The annular seal 78 of the first pressure control device 48 may converge in one longitudinal direction, an annular seal 78 of the second pressure control device 108 may converge in an opposite longitudinal direction.

The subsea assembly 34 may include a longitudinally extendable and compressible slip joint 110. The slip joint 110 may be connected between the first pressure control device 48 and the connector 40.

Also provided to the art by the above disclosure is a system 10 for use with a subterranean well. In one example, the system 10 can include a subsea assembly 34 configured to releasably connect to a subsea wellhead installation 18, the subsea assembly 34 being free of any riser connection. The subsea assembly 34 includes a first pressure control device 48 comprising an outer housing 80, and an annular seal 78 configured to seal off an annulus 76 formed between the outer housing 80 and a tubular string 66 extending through the outer housing 80.

The subsea assembly 34 can include a connector 40 configured to releasably connect the subsea assembly 34 to the subsea wellhead installation 18. The subsea assembly 34 may further include a guide 56 configured to guide the tubular string 66 into an internal flow passage 58 extending through the subsea assembly 34. The first pressure control device 48 may be connected between the guide 56 and the connector 40.

The subsea assembly 34 may include a pump 102 having an inlet in communication with the internal flow passage 58 between the first pressure control device annular seal 78 and the connector 40, and an outlet in communication with an umbilical 36 that extends to a rig 12. The subsea assembly 34 may further include a longitudinally extendable and compressible slip joint 110 connected between the first pressure control device 48 and the connector 40.

The subsea assembly 34 may include first and second annular seal barriers 46, 52. The first pressure control device 48 may be connected between the first and second annular seal barriers 46, 52. The first annular seal barrier 46 may be configured to seal off the annulus 76 in response to application of fluid pressure to the first annular seal barrier 46, and the second annular seal barrier 52 may be configured to seal off the annulus 76 in response to application of fluid pressure to the second annular seal barrier 52.

The subsea assembly 34 may include a cleaning assembly 50 including nozzles 88 configured to direct a cleaning fluid 92 toward the tubular string 66. The cleaning assembly 50 may further include a pump 98 having an inlet in communication with the annulus 76 between the nozzles 88 and the first pressure control device annular seal 78, and an outlet in communication with an umbilical 36 that extends to a rig 12.

The subsea assembly 34 may include a second pressure control device 108. The annular seal 78 of the first pressure control device 48 may converge in one longitudinal direction, and an annular seal 78 of the second pressure control device 108 may converge in an opposite longitudinal direction.

A method of conducting a managed pressure operation from a water-based rig 12 is also provided to the art by the above disclosure. In one example, the method can include assembling a subsea assembly 34 comprising a first pressure control device 48 and a connector 40, the first pressure control device 48 including an outer housing 80, and an annular seal 78 configured to seal off an annulus 76 formed between the outer housing 80 and a tubular string 66 extending through the outer housing 80; lowering the subsea assembly 34 through water 38 from the rig 12 to a subsea wellhead installation 18; connecting the subsea assembly 34 to the subsea wellhead installation 18; and positioning the tubular string 66 in an internal flow passage 58 extending through the subsea assembly 34, whereby the annular seal 78 seals against an external surface of the tubular string 66. The tubular string is exposed to, and in contact with, the water 38 between the rig 12 and the subsea assembly 34.

In the positioning step, the tubular string 66 does not extend through any riser.

The assembling step may comprise connecting the first pressure control device 48 between first and second annular seal barriers 46, 52. The method may include applying pressure to the first annular seal barrier 46, thereby sealing off the annulus 76 in the first annular seal barrier 46.

The connecting step may comprise connecting the connector 40 of the subsea assembly 34 to a lower marine package 22 of the subsea wellhead installation 18. The positioning step may include a guide 56 of the subsea assembly 34 guiding the tubular string 66 into the internal flow passage 58, and the assembling step may include connecting the first pressure control device 48 between the connector 40 and the guide 56.

The assembling step may include connecting a second pressure control device 108 in the subsea assembly 34. The annular seal 78 of the first pressure control device 48 may converge in a first longitudinal direction, an annular seal 78 of the second pressure control device 108 may converge in a second longitudinal direction, and the second longitudinal direction may be opposite to the first longitudinal direction.

The assembling step may include connecting a longitudinally extendable and compressible slip joint 110 in the subsea assembly 34 between the first pressure control device 48 and the connector 40.

The assembling step may include connecting a cleaning assembly 50 in the subsea assembly 34. The cleaning assembly 50 may include nozzles 88 configured to direct a cleaning fluid 92 toward the tubular string 66.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A subsea assembly, comprising:

a first pressure control device comprising an outer housing, and an annular seal configured to seal off an annulus formed between the outer housing and a tubular string extending through the outer housing;

a connector configured to releasably connect the subsea assembly to a subsea wellhead installation;

a guide configured to guide the tubular string into an internal flow passage extending through the subsea assembly, in which the first pressure control device is connected between the connector and the guide; and a longitudinally extendable and compressible slip joint connected between the first pressure control device and the connector.

2. The subsea assembly of claim 1, in which the subsea assembly is free of any riser connection.

3. The subsea assembly of claim 1, further comprising first and second annular seal barriers, the first pressure control device being connected between the first and second annular seal barriers.

4. The subsea assembly of claim 3, in which the first annular seal barrier is configured to seal off the annulus in response to application of fluid pressure to the first annular seal barrier, and the second annular seal barrier is configured to seal off the annulus in response to application of fluid pressure to the second annular seal barrier.

5. The subsea assembly of claim 1, further comprising a pump having an inlet in communication with the internal flow passage between the first pressure control device annular seal and the connector, and an outlet in communication with an umbilical that extends to a rig.

6. The subsea assembly of claim 1, further comprising a cleaning assembly, the cleaning assembly including nozzles configured to direct a cleaning fluid toward the tubular string.

7. The subsea assembly of claim 6, further comprising a pump having an inlet in communication with the internal flow passage between the nozzles and the first pressure control device annular seal, and an outlet in communication with an umbilical that extends to a rig.

8. The subsea assembly of claim 1, in which the first pressure control device further comprises a bearing assembly that permits rotation of the annular seal relative to the outer housing.

9. The subsea assembly of claim 1, further comprising a second pressure control device, the second pressure control device being connected between the guide and the first pressure control device.

10. The subsea assembly of claim 9, in which the annular seal of the first pressure control device converges toward an external surface of the tubular string in a first longitudinal direction, an annular seal of the second pressure control device converges toward the external surface of the tubular string in a second longitudinal direction, and the second longitudinal direction is opposite to the first longitudinal direction.

11. A method of conducting a managed pressure operation from a water-based rig, the method comprising:

assembling a subsea assembly comprising a first pressure control device and a connector, the first pressure control device including an outer housing, and an annular seal configured to seal off an annulus formed between the outer housing and a tubular string extending through the outer housing, in which the assembling further comprises connecting a longitudinally extendable and compressible slip joint in the subsea assembly between the first pressure control device and the connector;

lowering the subsea assembly through water from the rig to a subsea wellhead installation;

connecting the connector of the subsea assembly to the subsea wellhead installation; and positioning the tubular string in an internal flow passage extending through the subsea assembly, whereby the annular seal seals against an external surface of the tubular string, the tubular string being exposed to the water between the rig and the subsea assembly.

12. The method of claim 11, in which in the positioning, the tubular string does not extend through any riser.

13. The method of claim 11, in which the assembling comprises connecting the first pressure control device between first and second annular seal barriers.

14. The method of claim 13, further comprising applying pressure to the first annular seal barrier, thereby sealing off the annulus in the first annular seal barrier.

15. The method of claim 11, in which the connecting comprises connecting the connector of the subsea assembly to a lower marine package of the subsea wellhead installation, in which the positioning comprises a guide of the subsea assembly guiding the tubular string into the internal flow passage, and in which the assembling comprises connecting the first pressure control device between the connector and the guide.

16. The method of claim 11, in which the assembling comprises connecting a second pressure control device in the subsea assembly.

17. The method of claim 16, in which the annular seal of the first pressure control device converges toward an external surface of the tubular string in a first longitudinal direction, an annular seal of the second pressure control device converges toward the external surface of the tubular string in a second longitudinal direction, and the second longitudinal direction is opposite to the first longitudinal direction.

18. The method of claim 11, in which the assembling further comprises connecting a cleaning assembly in the subsea assembly, the cleaning assembly comprising nozzles configured to direct a cleaning fluid toward the tubular string.

* * * * *